US005979950A

United States Patent [19]

Prevot et al.

[11] Patent Number: 5,979,950

[45] Date of Patent: Nov. 9, 1999

[54] FITTING FOR SLIDING DOOR, WINDOW OR LIKE CLOSURE

[75] Inventors: Gérard Prevot, Willerwald; Gérard Desplantes, Sarrebourg; Eric Alvarez, Hommert, all of France

[73] Assignee: Ferco International Ferrures et Serrures de Batiment, France

[21] Appl. No.: 09/054,773

[22] Filed: Apr. 3, 1998

[30] Foreign Application Priority Data

Apr. 3, 1997 [FR] France ..... 97 04069

[51] Int. Cl.[6] ..... E05C 1/04

[52] U.S. Cl. ..... 292/150; 70/DIG. 57; 411/913

[58] Field of Search ..... 70/DIG. 57; 292/140, 292/150, 302, DIG. 51; 411/84, 85, 104, 508, 509, 913

[56] References Cited

U.S. PATENT DOCUMENTS

| | | | |
|---|---|---|---|
| 264,776 | 9/1882 | Sharp . | |
| 3,904,229 | 9/1975 | Waldo | 292/29 |
| 4,094,271 | 6/1978 | Louis | 119/5 |
| 4,103,946 | 8/1978 | Tipler | 292/114 |
| 4,401,247 | 8/1983 | Zoor | 224/315 |
| 4,621,230 | 11/1986 | Crouch et al. | 324/110 |
| 5,112,175 | 5/1992 | Wilkening | 411/371 |
| 5,412,848 | 5/1995 | Precourt, Jr. | 24/99 |
| 5,470,184 | 11/1995 | Chandler | 411/377 |
| 5,829,936 | 11/1998 | Omori et al. | 411/509 |

FOREIGN PATENT DOCUMENTS

| | | | |
|---|---|---|---|
| 0 044 264 | 1/1982 | European Pat. Off. . | |
| 0 389 448 | 9/1990 | European Pat. Off. . | |
| 2701056 | 8/1994 | France | 292/DIG. 46 |
| WO 95/29314 | 11/1995 | WIPO . | |

*Primary Examiner*—Steven Meyers
*Assistant Examiner*—Clifford B Vaterlaus
*Attorney, Agent, or Firm*—Kenyon & Kenyon

[57] ABSTRACT

In a lock fitting for sliding closures a bolt-carrier includes a screwthreaded hole with its axis perpendicular to a covering plate to receive a screw for immobilizing a bolt on the bolt-carrier. The covering plate has an orifice for access to the screw and to the screwthreaded hole on the axis of the screwthreaded hole when the bolt-carrier is in its locked position. The fitting includes a plug to blank off the orifice. The plug can be retracted inside the casing to allow access to the screw and then returned to its normal position in which it blanks off the orifice.

10 Claims, 1 Drawing Sheet

FITTING FOR SLIDING DOOR, WINDOW OR LIKE CLOSURE

BACKGROUND OF THE INVENTION

1. Field of the Invention

The present invention concerns a fitting for sliding door, window or like closures including an elongate casing adapted to be inserted in an elongate slot in the inside wall of the closure, a covering plate forming an integral part of the casing and adapted to cover the elongate slot and a bolt-carrier adapted to slide in the longitudinal direction inside the casing, the bolt-carrier including at least one screwthreaded hole with its axis perpendicular to the covering plate adapted to receive a screw for immobilizing a bolt on the bolt-carrier.

2. Description of the Prior Art

In some prior art fittings a plurality of holes are provided for adjusting and immobilizing the bolt on the bolt-carrier and open onto the outside face of the slider with the result that the heads of the adjustment and/or immobilizing screws can be seen from the outside. The presence of such holes is undesirable from the esthetic point of view and weakens the bolt-carrier. Blanking off these holes in the outside plate is a problem to which it is difficult to find a solution that is satisfactory from the reliability and esthetic points of view.

Other prior art fittings include an orifice in the outside plate for access to the bolt-carrier in the locked position of the latter. This orifice is used to adjust the bolt relative to the striker in the closed position of the closure and to immobilize the bolt in this closed position, which guarantees optimal adjustment of the bolt. However, the orifice in the outside plate must be blanked off by a cover that is of poor appearance and can drop off or be mislaid.

The aim of the present invention is to remedy the drawbacks of the prior art fittings and to propose a fitting of the above type including an orifice and means for blanking off the orifice having a satisfactory appearance and adapted to enable very easy and very reliable access to the orifice.

SUMMARY OF THE INVENTION

In accordance with the present invention in a fitting of the above type the covering plate has an orifice for access to the screw and to the screwthreaded hole on the axis of the screwthreaded hole when the bolt-carrier is in its locked position and the fitting includes a plug adapted to blank off the orifice, means for retracting the plug inside the casing to allow access to the screw and means for returning the plug to its normal position in which it blanks off the orifice Because the plug can retract inside the casing the bolt can be adjusted relative to the striker in the locked position of the bolt-carrier after which the plug is returned to its normal position. In this way the bolt can be optimally adjusted and immobilized relative to the striker. The plug is much more discrete than an external cover and cannot be damaged or lost.

Other features and advantages of the present invention will become apparent from the following detailed description given by way of non-limiting example only with reference to the appended drawings.

DETAILED DESCRIPTION OF THE PREFERRED EMBODIMENTS

Figure 2:
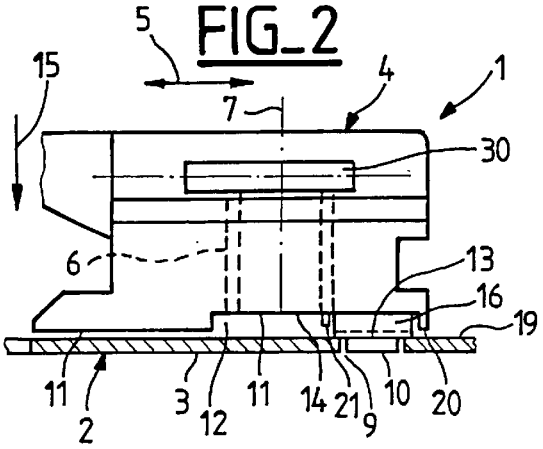
FIG. 2 is a view similar to FIG. 1 showing the bolt-carrier in its unlocked position.
Figure 1:
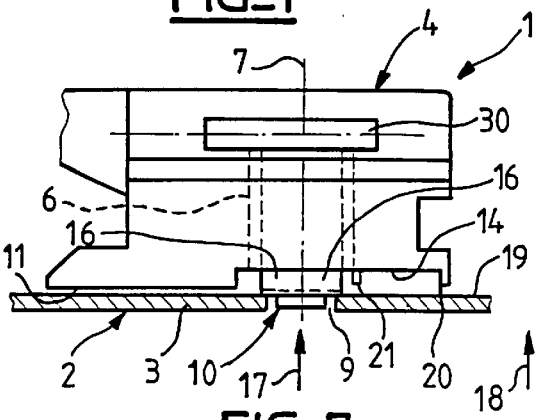
FIG. 1 is a part-sectional view representing a bolt-carrier in a position sliding along the covering plate of a casing of a fitting constituting one embodiment of the present invention showing the bolt-carrier in its locked position.

In the embodiment shown in FIGS. 1 and 2 the fitting 1 for a sliding door, window or like closure (not shown) includes an elongate casing 2 adapted to be inserted in an elongate slot (not shown) in the inside wall (not shown) of the closure, a covering plate 3 forming an integral part of the casing 2 and adapted to cover the elongate slot and a bolt-carrier 4 adapted to slide in the longitudinal direction 5 inside the casing 2. The bolt-carrier 4 includes at least one screwthreaded hole 6 with its axis 7 perpendicular to the covering plate 3 and adapted to receive a screw 8 (see FIG. 4) for immobilizing a bolt 31 on the bolt-carrier 4.

In accordance with the present invention the covering plate 3 includes an orifice 9 for access to the screw 8 and the screwthreaded hole 6. The orifice 9 is on the axis 7 of the screwthreaded hole 6 when the bolt-carrier 4 is in its locked position shown in FIG. 1.

The fitting 1 includes a plug 10 adapted to blank off the orifice 9, means for retracting the plug 10 inside the casing 2 to enable access to the screw 8 and means for returning the plug 10 to its normal position in which it blanks off the orifice 9.

As shown in the figures the bolt-carrier 4 has on its face 11 adjacent the covering plate 3 a recess 12 extending in the longitudinal direction 5 of the casing 2, facing the orifice 9 and adapted to receive the plug 10 in the locked and unlocked positions of the bolt-carrier 4.

The plug 10 has on its face 13 facing towards the back 14 of the recess 12 spring means adapted to bear on said back 14 to spring-load the plug 10 in the direction 15 towards its normal position (FIGS. 1 and 2) in which it blanks off the orifice 9.

The spring means are shown diagrammatically in FIGS. 1 and 2 by a rectangle 16.

Figure 9:
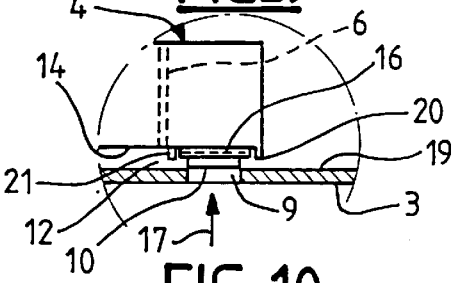
Figure 10:
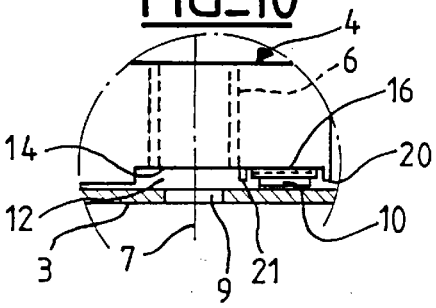

As will emerge below in connection with FIGS. 9 and 10 the spring means 16 are adapted to be compressed by applying pressure symbolized by the arrow 17 from the outside on the plug 10 in the direction 18, opposite the direction 15, towards the interior of the casing 2 to cause the plug 10 to move a sufficient distance to enter completely into the recess 12, between the back 14 of the recess 12 and the internal face 19 of the covering plate 3.

The bolt-carrier 4 has on the back 14 of the recess 12 two members 20, 21 projecting towards the covering plate 3 and located so that in the unlocked position of the bolt-carrier 4 shown in FIG. 2 the two projecting members 20, 21 are placed in the longitudinal direction 5 of the bolt-carrier 4 on respective opposite sides of the plug 10.

As shown in FIGS. 1 and 2 when the plug 10 is in its normal position in the orifice 9 the spring means 16 do not impede the passage of at least one (21) of the projecting members 20, 21 when the bolt-carrier 4 slides in the direction 5 and when the spring means 16 are in the compressed position (see below) the projecting members 20, 21 are adapted to engage with the plug 10 to move said plug 10 one way or the other when the bolt-carrier 4 slides in the longitudinal direction 5.

The projecting members 20, 21 extend in the direction 15 towards the covering plate 3 to a distance at most equal to the distance by which said spring means 16 can be compressed.

Figure 3:
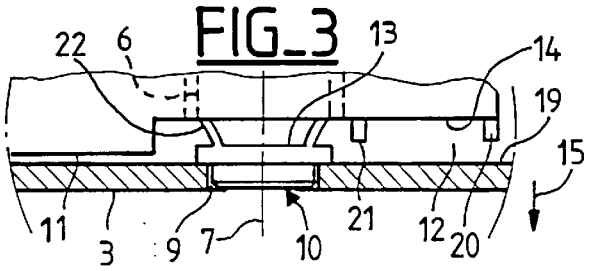
FIG. 3 is a view to a larger scale of a detail from FIG. 1 showing one embodiment of the plug of the present invention.
Figure 4:
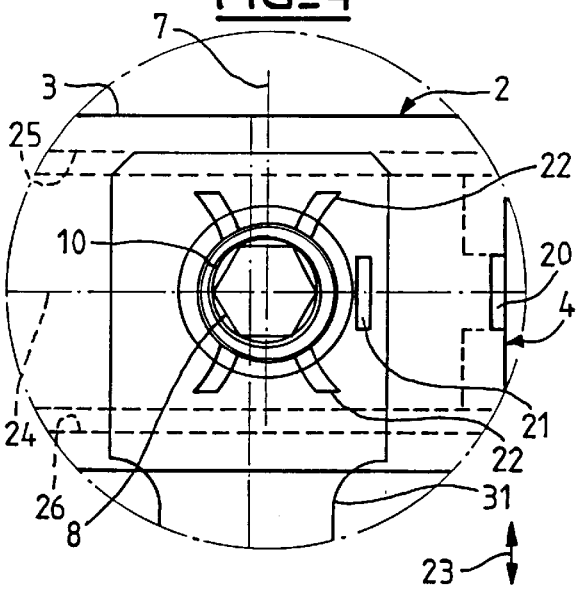
FIG. 4 is a partial bottom view of the fitting from FIG. 3.

In the embodiment shown in FIGS. 3 and 4 the spring means 16 are lugs 22 separated from each other in the transverse direction 23 of the casing 2. Accordingly the projecting members 20, 21 which are substantially on the longitudinal axis 24 of the bolt-carrier 4 can easily pass between the lugs 22 on the plug 10 when the bolt-carrier 4 slides.

In the embodiment of FIGS. 3 and 4 the four lugs 22 project in the direction 18 towards the back 14 of the recess 12 and substantially radially towards the outside of the plug 10.

Accordingly two of the lugs 22 project in the transverse direction 23 of the casing 2 towards respective longitudinal lateral walls 25, 26 of the casing 2.

Similarly, two of the lugs 22 project opposite ways in the longitudinal direction 5 of the casing 2.

The plug 10 must be prevented from rotating on itself inside the recess 12 to prevent the spring means 16 impeding movement of the projecting members 20, 21 when the bolt-carrier 4 slides and thereby impeding correct operation of the fitting.

The plug 10 includes means adapted to bear on the lateral longitudinal walls 25, 26 of the casing 2 to hold the plug 10 in a position in which the spring means 16, 22 do not impede the passage of the projecting members 20, 21.

In this direction the means 16 are configured at their ends so that, once spring-loaded, they bear on the lateral longitudinal walls 25, 26 of the casing so that the spring means 16 do not in any way impede the passage of the projecting members 20 and 21 in any position.

The lugs 22 are adapted to bear substantially on the lateral longitudinal walls 25, 26 of the casing 2 in the compressed position of the plug 10 in that, in this example, the recess 12 extends in the transverse direction 23 of the casing 2 across all of the transverse dimension of said casing 2.

In this way the plug 10 is perfectly centered in the recess 12.

The lugs 22 prevent any rotation of the plug 10 in the orifice 9 likely to move the lugs 22 into a position where they may impede sliding of the projecting members 20, 21 when the plug 10 is in its normal position in which it blanks off the orifice 9.

Figure 5:
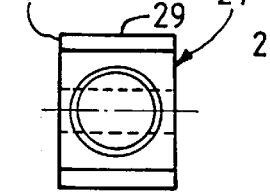
FIG. 5 is a partial view similar to FIG. 4 representing another embodiment of the plug of the present invention.
Figure 6:
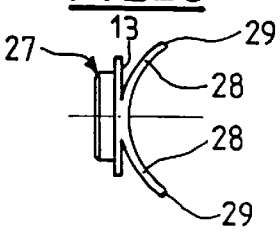
FIG. 6 is a side view of the plug from FIG. 5.

In the embodiment of FIGS. 5 and 6 the plug 27 includes two part-cylindrical lugs 28 terminating in longitudinal edges 29 adapted to bear against the back 14 of the recess 12. The lugs 28 are also adapted to bear on the lateral longitudinal walls 25, 26 of the casing 2 to prevent any unwanted rotation of the plug 27.

Where applicable, everything stated hereinabove concerning the plug 10 and the lugs 22 can be transposed to the plug 27 and the lugs 28.

FIGS. 7 through 10 show the various phases of the operation to retract the plug 10, 27 inside the recess 12.

Figure 7:
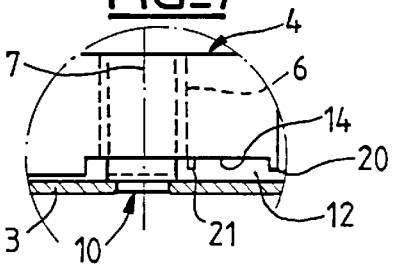
FIGS. 7 through 10 are views of a detail from FIG. 1 showing the operation of the plug of the fitting of the present invention.

In the locked position of the bolt-carrier 4 shown diagrammatically in FIG. 7 the plug 10 is in its normal position in the orifice 9 in the covering plate 3. The plug 10 faces the screwthreaded hole 6 in the bolt-carrier 4.

The first projecting member 20 is the projecting member on the right in the figure, at the same end as the bolt-carrier 4 in the closed position.

The second projecting member 21 is substantially centred in the recess 12 in the longitudinal direction 5.

The two sections of the recess 12 on respective opposite sides of the second projecting member 21 have a length in the longitudinal direction 5 sufficient to receive the plug 10, as shown diagrammatically in figures 1 and 2.

Figure 8:
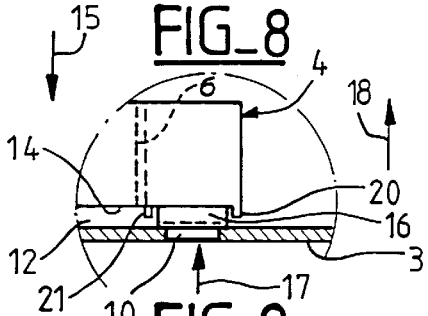

Starting from the locked position of the bolt-carrier 4 shown in FIG. 7 the bolt-carrier 4 slides towards its unlocked position (FIG. 2) until it reaches the situation shown diagrammatically in FIG. 8 in which the plug 10 is between the two projecting members 20, 21.

In the FIG. 8 position pressure symbolized by the arrow 17 is applied to the outside face of the plug 10 in the direction 18 towards the inside of the casing. This crushes the spring means symbolized by the rectangle 16 and causes the plug 10 to enter the recess 12 in its entirety.

The bolt-carrier 4 is then returned to its locked position (FIG. 1): the plug 10 in its crushed position is engaged with the second projecting member 21 which causes it to slide with the bolt-carrier towards the right in the figure between the internal face 19 of the covering plate 3 and the back 14 of the recess 12. This exposes the orifice 9 when the screwthreaded hole 6 is located in front of said orifice 9 and provides access to the screw 8 (see FIG. 10). There is easy access for suitable tools for the mode of adjustment and tightening adopted.

A captive plug has therefore been described and shown which is adapted to blank off the orifice 9 discreetly and reliably and where necessary to provide direct access to the screw 8 and to the bolt 31 after removing the screw 8.

Of course, the present invention is not limited to the embodiments just described and many changes and modifications can be made to the latter without departing from the field of the invention.

Accordingly the lugs 22, 28 can be replaced by similar means. Also more than one plug can be provided on the covering plate of the fitting.

What is claimed is:

1. A fitting for a sliding closure such as a door or a window, said fitting including an elongate casing adapted to be inserted in an elongate slot in an inside wall of said closure, a covering plate forming an integral part of said casing and adapted to cover said elongate slot, a bolt-carrier slidable in a longitudinal direction inside said casing, said bolt-carrier including at least one screwthreaded hole with its axis perpendicular to said covering plate, and a screw for immobilizing a bolt on said bolt-carrier receivable within said screwthreaded hole, wherein said covering plate has an orifice for access to said screw and to said screwthreaded hole on the axis of said screwthreaded hole when said bolt-carrier is in a locked position, said fitting further including a plug at least partially received within said casing, means for retracting said plug inside said casing to allow access to said screw, and means for returning said plug to a normal position in which it blanks off said orifice.

2. The fitting of claim 1 wherein said bolt-carrier has on a face adjacent said covering plate a recess extending in said longitudinal direction and facing said orifice, said recess receiving said plug within it when said bolt-carrier is in said locked position and in an unlocked position.

3. The fitting of claim 2 wherein said plug has, on a face facing towards a back of said recess, spring means adapted to bear on said back to spring-load said plug in a direction towards said normal position in which said plug blanks off said orifice.

4. The fitting of claim 3 wherein said spring means are compressible into a compressed position by applying pressure to said plug from a location outside of said casing in a direction towards the inside of said casing to move said plug a sufficient distance for said plug to enter completely said recess between said back of said recess and an internal face of said covering plate.

5. The fitting of claim 4 wherein said bolt-carrier includes on said back of said recess two members projecting in a direction towards said covering plate and disposed so that when said bolt-carrier is in said unlocked position said two projecting members are placed in said longitudinal direction on respective opposite sides of said plug.

6. The fitting of claim 5 wherein when said plug is in said normal position said spring means do not impede passage of at least one of said projecting members when said bolt-carrier slides and wherein when said spring means are in the compressed position at least one of said projecting members engage with said plug to move said plug one way or another upon sliding of said bolt-carrier.

7. The fitting of claim 6 wherein said projecting members extend in said direction towards said covering plate to a distance at most equal to a distance by which said spring means can be compressed.

8. The fitting of claim 7 wherein said spring means are at least two lugs spaced from each other in a transverse direction of said casing.

9. The fitting of claim 6 wherein said plug includes means adapted to bear on first and second lateral longitudinal walls of said casing to hold said spring means in a position that does not impede the passage of said at least one of said projecting members.

10. The fitting of claim 8 wherein said lugs bear substantially on first and second lateral longitudinal walls of said casing when said plug is in said compressed position.

* * * * *